US007036277B2

(12) United States Patent
Burginger

(10) Patent No.: US 7,036,277 B2
(45) Date of Patent: May 2, 2006

(54) MODULAR BUILDING ELEMENT

(76) Inventor: Mark A. Burginger, 12944 Camino del Valle, Poway, CA (US) 92064

( * ) Notice: Subject to any disclaimer, the term of this patent is extended or adjusted under 35 U.S.C. 154(b) by 412 days.

(21) Appl. No.: 10/256,452

(22) Filed: Sep. 26, 2002

(65) Prior Publication Data

US 2004/0206014 A1 Oct. 21, 2004

(51) Int. Cl.
*E04H 14/00* (2006.01)

(52) U.S. Cl. ..... 52/79.4; 52/81.3; 52/81.4

(58) Field of Classification Search ..... 52/79.1, 52/79.4, 81.1, 81.3, 81.4
See application file for complete search history.

(56) References Cited

U.S. PATENT DOCUMENTS 3,660,952 A * 5/1972 Wilson ..... 52/81.4
4,133,149 A * 1/1979 Angress ..... 52/70
4,413,452 A * 11/1983 Wilkinson ..... 52/82
4,425,740 A * 1/1984 Golden ..... 52/81.1
6,173,538 B1 * 1/2001 Fleishman ..... 52/81.4

* cited by examiner

*Primary Examiner*—Carl D. Friedman
*Assistant Examiner*—Yvonne M. Horton
(74) *Attorney, Agent, or Firm*—Charmasson, Buchaca & Leach, LLP

(57) ABSTRACT

A versatile modular building element, made from the agglutination of three pairs of symmetrical prisms in three overlapping tiers, provides an arched component that can be congruently meshed with a similar one in several different ways. The prism may have rectangular or obliquely parallelogrammic sides or a combination of both while keeping their triangular end walls equilateral and side walls of the same width allowing for up to eight different configurations of the building element. Elements of the same or different types can be combined to construct and infinite variety of structures exhibiting high compressive strength, stability and resistance to multi-directional stresses.

18 Claims, 6 Drawing Sheets

MODULAR BUILDING ELEMENT

FIELD OF THE INVENTION

This invention relates to modular building blocks and building devices where modules with symmetrical surfaces are capable of rigidly fitting together to create a multitude of crystaline and other structures.

BACKGROUND OF THE INVENTION

The prior art is replete with examples of modular building blocks having complex mating interfaces so that these blocks can be assembled into mortarless walls and other types of masonry structures. The toy industry has also provided a great number of building block sets having a variety of interlocking features as exemplified by the popular construction sets sold under the registered brand name LEGGO. U.S. Pat. No. 5,623,790 Lalvani discloses some more sophisticated building modules based on combination of polyhedron structures that can fit together into a variety of orderly and irregular-looking bodies with multidirectional interlocking surfaces. These types of building blocks are touted for a variety of applications from architectural structures to educational kits and toys.

The instant invention results from a search for an improved version of a building module based on a conglomeration of simple polyhedral shapes with improved load capacity and resistance to multi-directional shearing forces.

SUMMARY OF THE INVENTION

One of the primary objects of this invention is to provide sets of modular building blocks that come into contact with each other over a congruent and matching amount of surface area in order to distribute stress more evenly and yield ever stronger structures.

It is also an object of this invention to provide a new and improved structural system which defines a space intermediate the generally spherical structure and the traditional cubic or rectangular one most commonly used by the building industry.

Another object of this invention is to provide a building unit which combines the structural efficiency of the equilateral triangle with the simplicity and inherent modularity of the square or rectangle.

A further object of this invention is to provide a basic architectural component which, by means of self-triangulated elements, distributes the stress throughout the structure and at the same time has the modular ability to interlock, over a large area and in a variety of congruent mating surfaces.

These and other valuable objects are achieved by combining pairs of symmetrical prisms in several tiers where half the surface of a prism wall, is congruently bonded to half the surface of the wall of a prism in an adjacent tier. The prisms have parallel and equilateral end walls but may have side walls that are either rectangular or obliquely parallelogrammic. The mating ability of the modules is improved by having a two-to-one ratio between the length and width of the prism side walls. The modules can be interlocked in a variety of orientations.

The invention contemplates that the modules can be combined to provide simple and inexpensive building and housing construction with rigid and stable geometry and structural efficiency. The triangular interspace between assembled modules can be sealed off to form part of the building system, thereby providing optimum use of the internal volume of each module and increasing the overall stability of the structure. Conversely, according to other aspects of the invention, some faces of the modules can have openings to allow sharing of the interspace and flow of grout, mortar or other bonding material.

In other forms contemplated by the invention, the modules can be transformed in size by simply changing the length and width of the walls of their component prisms. Furthermore, the modules can be slanted, twisted and otherwise altered in a mathematically determinable and definable manner according to transformations selected to create circles or spheres with modular capability and multiple layering levels.

Using the basic modular structure in building construction or decorative design formations, a load-carrying skeletal framework or structural wall members can be assembled. The wall members can be constructed of any suitable materials such as precast concrete slabs, wood, plastic, cardboard, sheet metal or meshing panels and laminated material. The walls of the prisms can be joined either over their entire surface or along their peripheral edges by any conventional manner, as by welding, bonding, or fastening with brackets, rivets or bolts. The modules can be prefabricated and assembled in factories or be assembled on the construction site, thereby lending themselves to inexpensive housing construction. Because only two wall components, namely, triangles and parallelograms are required for each module in either an orthogonal or oblique version, low cost, high volume and mass production is possible.

The prismatic character of the modules can be useful in the manufacture of instruments for refractometry, spectroscopy and laser light applications.

It should be noted that the modules can be covered with a mirroring surface for the collection of light waves. The invention contemplates that the primary modules can be arranged in various ways to provide effective components for use in telescopes and microscopes.

The positive and negative geometry of the module interlocking surfaces lend themselves to magnetic construction of toys and magnetic field generation devices.

Finally, because of the symmetrical laws governing the assembly of the modules and structures made therewith, aerodynamic and aquadynamic bodies can be conceived for new and unique applications.

DESCRIPTION OF THE PREFERRED EMBODIMENTS OF THE INVENTION

Figure 1A:
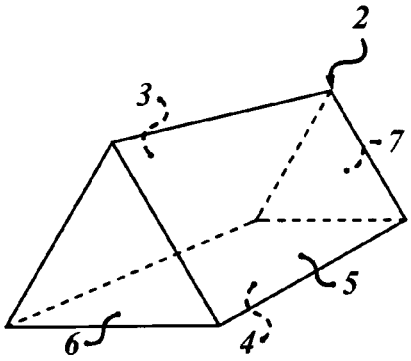
FIG. 1A illustrates basic prismatic components of the modular building block.
Figure 1B:
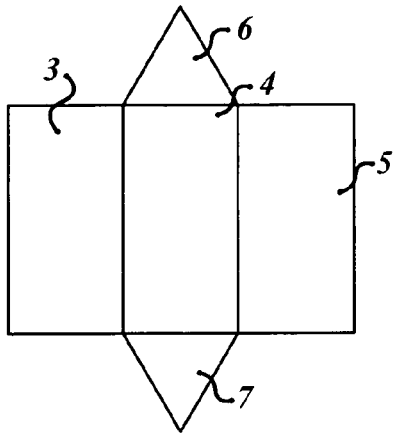
FIG. 1B is a flattened rendition of the prism walls.
Figure 1D:
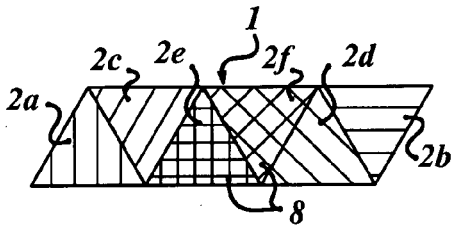
FIG. 1D is a top plan view thereof.
Figure 1F:
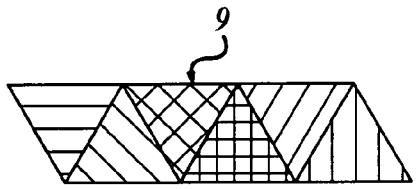
FIG. 1F is a top plan view thereof.
Figure 1C:
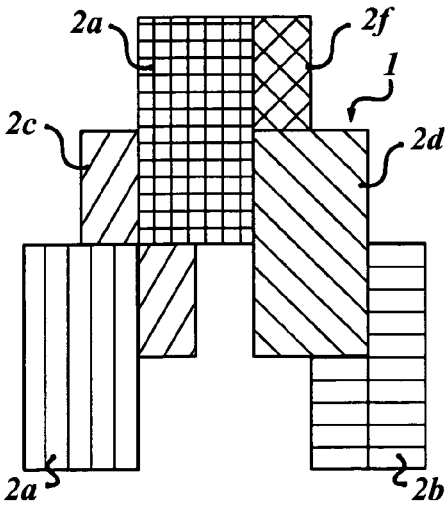
FIG. 1C is a front elevational view of a basic orthogonal module.

Referring now to the drawing, there is shown in FIG. 1A–1F a first orthogonal embodiment 1 of the modular building element according to the invention. The modular building element or module is intended to be combined with other similar modules in various interlocking arrangements to yield a variety of structures, some of which will be disclosed below. In this first embodiment, the module is composed of the agglutination of six symmetrical prisms of the type 2 illustrated in FIGS. 1A and B. As illustrated in FIG. 1B, the prism has three symmetrical and orthogonal, i.e., rectangular side walls 3, 4, 5 and two opposite equilaterally triangular end walls 6, 7. The prisms are arranged in three pairs. A first pair forming the bottom part of the module comprises the two prisms 2*a* and 2*b*. The upper half of a side wall in each of the first pair is attached or otherwise fixedly held against the bottom half of the side wall of a prism 2*c* or 2*d* of the second or median pair. Similarly, the upper half of a side wall of each prism in the second pair is fixedly held against a side wall of one of the prisms 2*e* or 2*f* in the third or upper pair. Each prism in the upper pair has a side wall congruently held against one of the side walls of the other prism. It should be noted that the two sides that are held together in the upper pair need not be formed by solid walls, instead, the sides could be bonded only around their peripheries leaving no median septum in the hexadhedron 8 formed by the prisms of the upper pair. It should also be noted that the overlapping portions of two bonded prisms could also be devoid of solid partition and only bonded along their peripheries; although, for better strength, each prism has preferably three solid side walls.

Since the two prisms of the median pair are spread apart by the prisms of the upper pair, and the prisms of the bottom pairs are similarly spread apart by the prisms of the median and top pairs, the module defines an arched structure with various angled but symmetrical outlining surfaces. The module can be expanded by adding to the bottom, successive pairs of prisms further and further apart. The size of the module can also be reduced by using only two pairs of prisms.

Figure 1E:
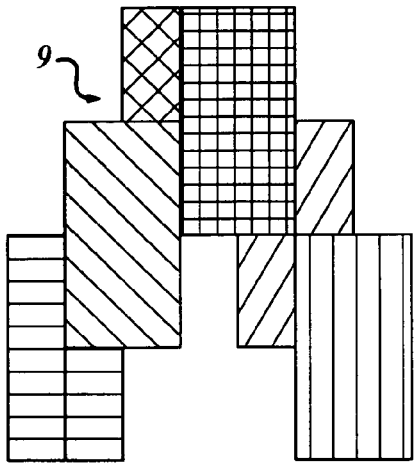
FIG. 1E is a front elevational view of a mirror image of the module in FIG. 1C.

A mirror image 9 of the just described module can be created as illustrated in FIGS. 1E and F where the orientation of each prism is simply rotated 180°.

Figure 2A:
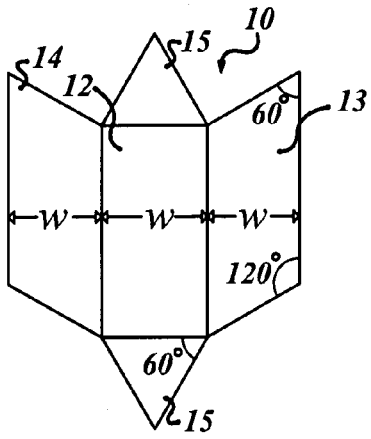
FIG. 2A is a flattened view of the wall in a first type of oblique prism component.
Figure 2B:
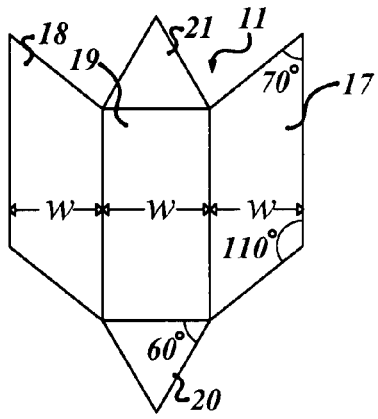
FIG. 2B is a flattened view of the walls in a second type of oblique prism component.

Illustrated in FIGS. 2A and 2B are two alternate prism components 10, 11 of a second embodiment of the modular building element. The prisms are characterized by the fact that their end walls are not perpendicular to their side walls. In the prisms of FIG. 2A, one side wall 12 is a rectangle. The two other side walls 13, 14 are obliquely parallelogrammic having complementary angles of 60° and 120°. The end walls 15, 16 define equilateral triangles that are parallel to each other and at a 60° angle in relation to the rectangular side wall 12. It should be noted that the common width W of the parallelogrammic side walls 13 and 14 is greater than the width w of the rectangular wall 12. In building a module with this type of prism, care must be taken that the side walls of the prisms that are held together are of the same size. As illustrated in FIG. 2B, a module 11 with obliquely parallelogrammic side walls 17, 18 exhibiting the same width W as its rectangular side wall 19 and still having equilateral end walls, 20, 21 can be had by giving the parallelogrammic sides complementary angles of 70° and 110°.

Figure 2C:
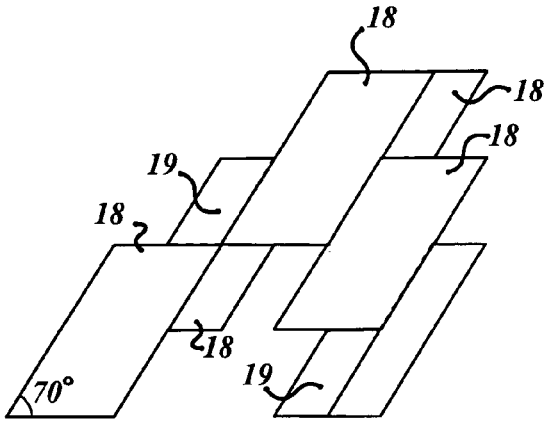
FIG. 2C is a front elevational view of first type of oblique module using the oblique prism of FIG. 2B.

Prisms of the types in FIG. 2B may be used to construct three different modules and their respective mirror images for a total of six different configurations. In a first configuration illustrated in FIG. 2C, the prisms are joined by one obliquely paralellogrammic side wall and the rectangular wall leaving one paralellogrammic wall in each prism free of attachment to any other prism. A second configuration (not illustrated) can be had by bonding the other paralellogrammic wall in each prism resulting in a module that would be slanted sideways in the opposite direction as the one in FIG. 2C.

Figure 2D:
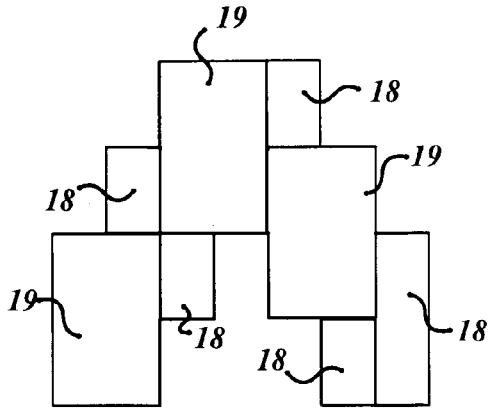
FIG. 2D is a front elevational view of a second type of oblique module based on the prism of FIG. 2B.

In a third configuration, illustrated in FIG. 2D, only the paralellogrammic walls of the prism are bonded to one another. In such a case, the module is leaning away from the viewer. Its mirror image would be leaning toward the viewer. Accordingly, one orthogonal version of the module and three distinct oblique versions plus their mirror images can be implemented having a common side wall width throughout and symmetrical equilaterally triangular end walls for a total of eight different, yet matingly compatible, modules.

Figure 3:
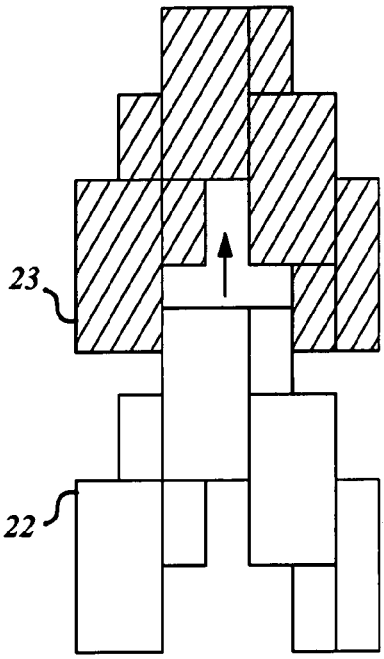
FIG. 3 is a frontal illustration of a first type of interconnection between two orthogonal modules.
Figure 4A:
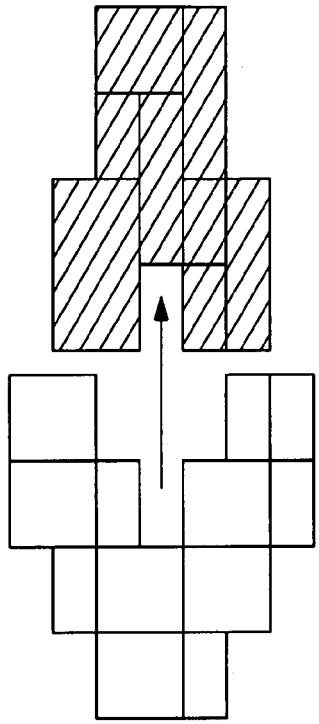
FIG. 4A is a frontal view of a second type of interconnection between the same modules.
Figure 4B:
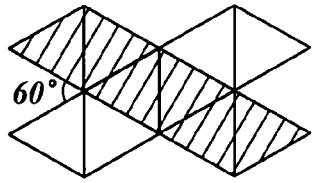
FIG. 4B is a top plan view of module assembled according to the manner illustrated in FIG. 4A.

Two or more orthogonal or obliquely parallelogrammic modules can be interconnected in different fashions. As illustrated in FIG. 3 in connection with orthogonal modules, the upper half 22 of a first module can be inserted into the central void 23 formed in the lower half of a second module. In another interlocking configuration, illustrated in FIGS. 4A and B, two modules are lined up bottom-to-bottom, shifted 60° apart then enmeshed into one another until the upper half of each is engaged into the lower half of the other.

Figure 5A:
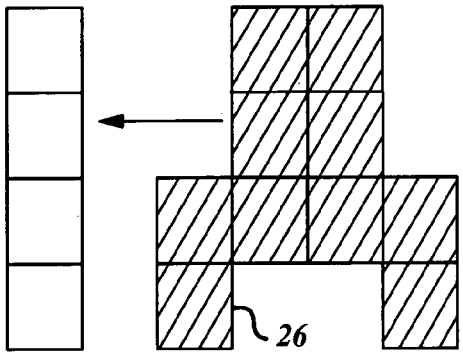
FIG. 5A is an illustration of a third interconnecting assembly between two modules.

In a third interconnecting arrangement illustrated in FIGS. 5A and B, a portion 26 of the lower half of one module is engaged into the void formed in the lower half of the other. The same three types of interconnecting arrangements can be practiced with all the oblique versions of the module. Moreover, different oblique versions can be combined so long as their prism components have symmetrical end walls and rectangular side walls and all side walls are of the same width.

The types of structures that can be constructed using the above-described modules are infinite in number. The following are some examples.

Figure 5B:
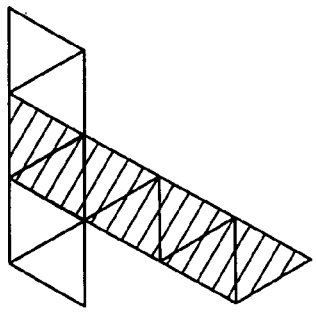
FIG. 5B is a top plan view of two module assembled according to the manner illustrated in FIG. 5A.
Figure 6A:
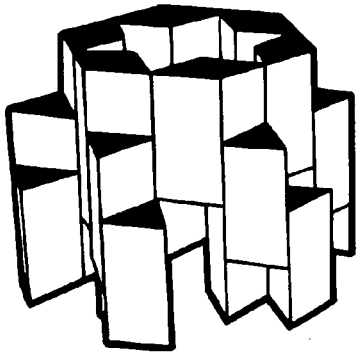
FIGS. 6A–6F are perspective views of structures constructed by assembling six modules according to the invention.
Figure 6B:
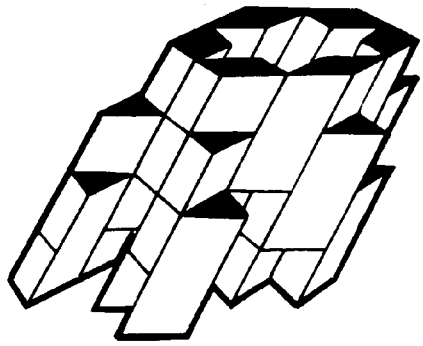
Figure 6C:
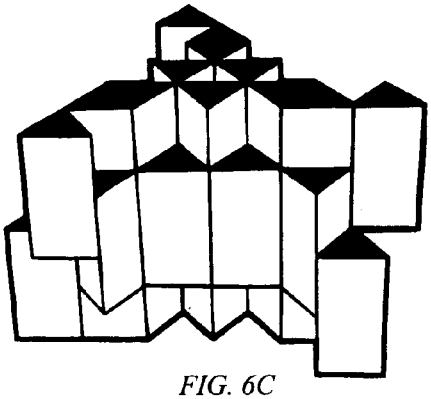
Figure 6D:
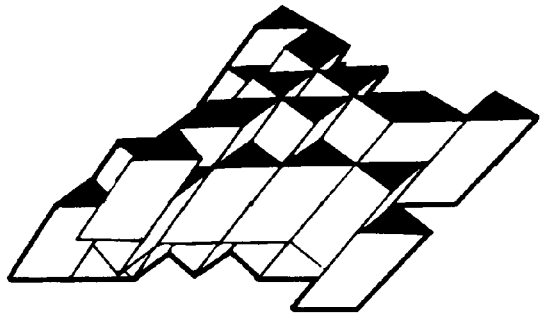
Figure 6E:
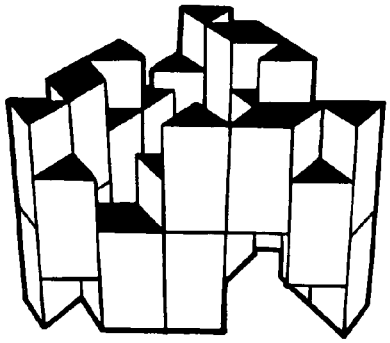
Figure 6F:
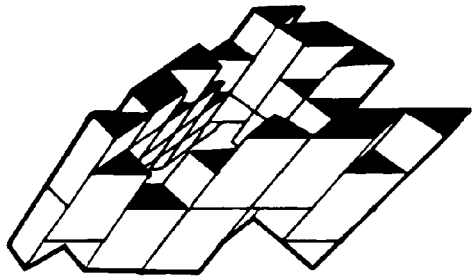

As shown in FIG. 6A, six orthogonal basic modules can be interlocked in the manner illustrated in FIGS. 5A–B to create a tower structure. FIG. 6B illustrates a similar tower structure made from oblique modules. The same six modules can also be combined in a triangular arrangement shown in FIGS. 6C and 6D using orthogonal and oblique modules respectively. Other combinations of six basic modules are shown in FIGS. 6E and 6F using orthogonal and oblique modules.

Figure 7A:
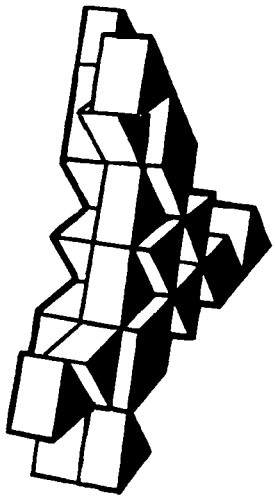
FIGS. 7A–7B are perspective views of a modular structure and its utilization in the construction of a sphere.
Figure 7B:
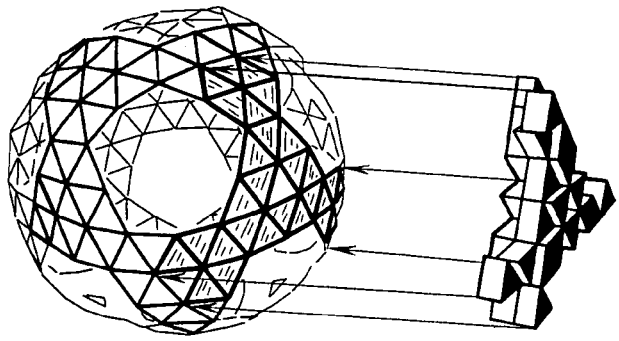

The flattened six modules of FIG. 7A can be used in the construction of a sphere as shown in FIG. 7B. The sphere can be constructed using fifty modules arranged in five levels or layers.

Figure 8:
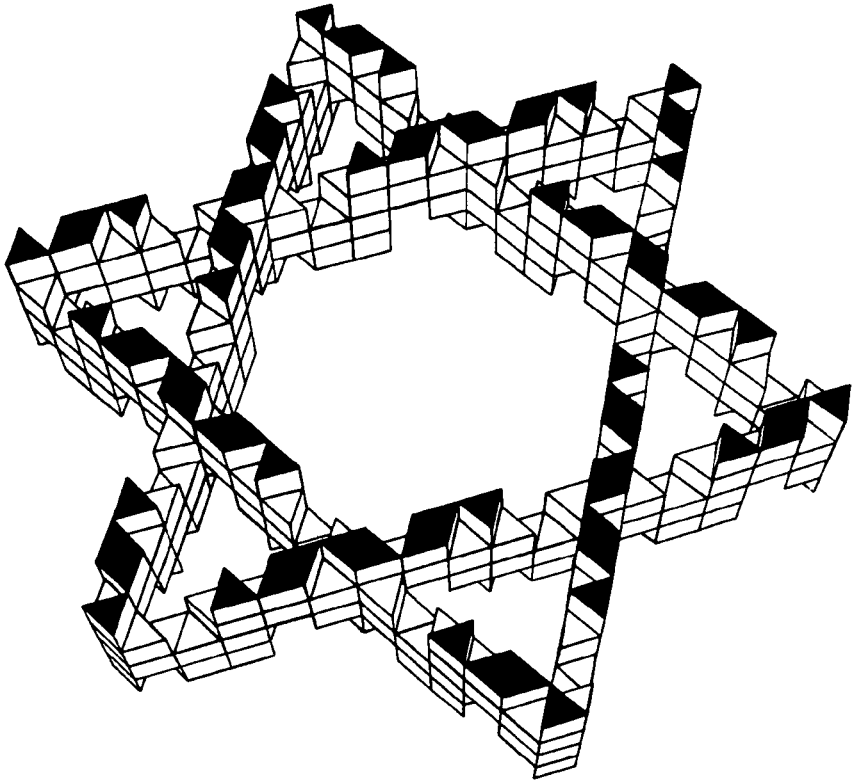
FIG. 8 is a perspective view of a star-shaped structure combining several modules.

Illustrated in FIG. 8 is a large star made from thirty-six orthogonal modules.

Figure 9A:
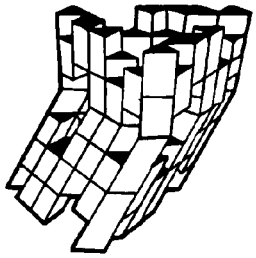
FIGS. 9A–9C are perspective views of the a modular structure from various angles.
Figure 9B:
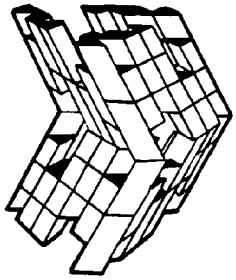
Figure 9C:
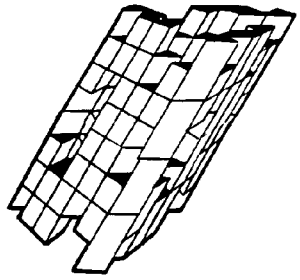
Figure 10A:
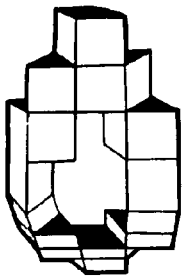
FIGS. 10A–10F are perspective views of another modular structure from various angles.
Figure 10B:
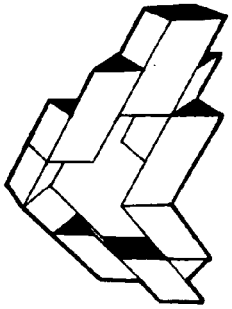
Figure 10C:
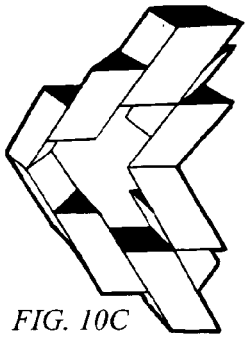
Figure 10D:
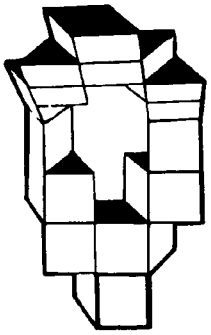
Figure 10E:
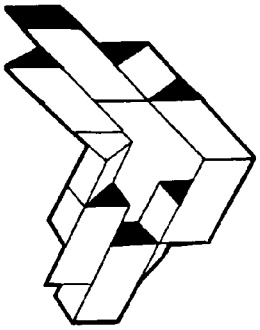
Figure 10F:
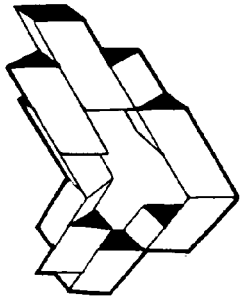

Illustrated in FIG. 9A–9C is the combination of twenty-four oblique modules rotated on the same fixed coordinates producting the illusion of a six-frame animation. The apparent movement accomplished by geometric transformations about a fixed point or points illustrates the usefulness in the invention as in educational toys.

FIGS. 10A–10F show six oblique module configuration from various angles.

While the preferred embodiments of the invention have been described, modifications can be made and other embodiments may be devised without departing from the spirit of the invention and the scope of the appended claims.

What is claimed is:

1. A modular building element which comprises:

three pairs of symmetrical prisms, each of said prisms having two opposite and triangular end walls and three contiguous parallelogrammic side walls;

each of a bottom pair of said prisms having an upper half of a side wall congruently and fixedly held against a lower half of a first side wall of one of a median pair of said prisms;

each of said median pair prisms having an upper half of a second side wall congruently and fixedly held against a lower half of a first side wall of one of a top pair of said prisms; and each said top pair prisms having a second side wall congruently, peripherally and fixedly held against a second side wall of the other prism in said top pair;

whereby said prisms define an arched structure having a top half congruently matable with the bottom half of a similar structure.

2. The modular building element of claim 1, wherein the end walls of each prism are parallel.

3. The modular building element of claim 2, wherein each of said end walls is equilateral.

4. The modular building element of claim 2, wherein each of said prisms comprises two obliquely parallelogrammic side walls.

5. The modular building element of claim 4, wherein said side walls have the same width.

6. The modular building element of claim 4, in combination with a symmetrical, mirror-image of itself.

7. A plurality of the modular building element of claim 1, wherein a portion of the lower half of one is engaged into the lower half of another.

8. A pair of the modular building element of claim 1, wherein an upper half of each is engaged into the lower half of the other.

9. A pair of the modular building element of claim 1, wherein one is the mirror-image of the other.

10. A modular building element which comprises:

three pairs of symmetrical prisms, each of said prisms having two opposite and triangular end walls and three contiguous side walls;

each of a bottom pair of said prisms having an upper half of a side wall congruently and fixedly held against a lower half of a first side wall of one of a median pair of said prisms;

each of said median pair prisms having an upper half of a second side wall congruently and fixedly held against a lower half of a first side wall of one of a top pair of said prisms;

each said top pair prisms having a second side wall congruently, peripherally and fixedly held against a second side wall of the other prism in said top pair;

whereby said prisms define an arched structure having a top half congruently matable with the bottom half of a similar structure;

wherein the end walls of each prism are parallel; and each of said prisms comprises three orthogonal side walls.

11. The modular building element of claim 10, wherein each of said side walls has a one-half width to length ratio.

12. A modular building element which comprises:

three pairs of symmetrical prisms, each of said prisms having two opposite and triangular end walls and three continuous side walls;

each of a bottom pair of said prisms having an upper half of a side wall congruently and fixedly held against a lower half of a first side wall of one of a median pair of said prisms;

each of said median pair prisms having an upper half of a second side wall congruently and fixedly held against a lower half of a first side wall of one of a top pair of said prisms;

each said top pair prisms having a second side wall congruently, peripherally and fixedly held against a second side wall of the other prism in said top pair;

whereby said prisms define an arched structure having a top half congruently matable with the bottom half of a similar structure;

wherein the end walls of each prism are parallel;

each of said prisms comprises two obliquely parallelogrammic side walls; and each of said prisms comprises one orthogonal side wall.

13. The modular building element of claim 12, wherein each of said prism end wall is equilateral.

14. The modular building element of claim 12, wherein each of said side walls has a one-half width to length ratio.

15. The modular building element of claim 12, wherein each orthogonal side wall of each prism is fixedly held against a side wall of another.

16. A plurality of modular building elements wherein each building element comprises:

three pairs of symmetrical prisms, each of said prisms having two opposite and triangular end walls and three contiguous side walls;

each of a bottom pair of said prisms having an upper half of a side wall congruently and fixedly held against a lower half of a first side wall of one of a median pair of said prisms;

each of said median pair prisms having an upper half of a second side wall congruently and fixedly held against a lower half of a first side wall of one of a top pair of said prisms;

each said top pair prisms having a second side wall congruently, peripherally and fixedly held against a second side wall of the other prism in said top pair;

whereby said prisms define an arched structure having a top half congruently matable with the bottom half of a similar structure; and wherein an upper half of one building element is congruently engaged into the lower half of another.

17. A modular building element which comprises:

three pairs of symmetrical prisms, each of said prisms having two opposite and triangular end walls and three contiguous side walls;

each of a bottom pair of said prisms having an upper half of a side wall congruently and fixedly held against a lower half of a first side wall of one of a median pair of said prisms;

each of said median pair prisms having an upper half of a second side wall congruently and fixedly held against a lower half of a first side wall of one of a top pair of said prisms;

each said top pair prisms having a second side wall congruently, peripherally and fixedly held against a second side wall of the other prism in said top pair;

whereby said prisms define an arched structure having a top half congruently matable with the bottom half of a similar structure;

wherein the end walls of each prism are parallel;

each of said prisms comprises two obliquely parallelogrammic side walls;

each of said prisms comprises one orthogonal side wall; and an obliquely parallelogrammic side wall of each prism is fixedly held against a obliquely parallelogrammic side wall of another.

18. A modular building element which comprises at least two pairs of symmetrical prisms, each of said prisms having three contiguous parallelogrammic side walls;

each of a bottom pair of said prisms having an upper half of a side wall fixedly held against a lower half of a first side wall of one of a top pair of said prisms; and each of said top pair prisms having a second side wall, peripherally and fixedly held against a second side wall of the other prisms in said top pair.

* * * * *